US005678768A

United States Patent [19]

Gager et al.

[11] Patent Number: 5,678,768

[45] Date of Patent: Oct. 21, 1997

[54] SHROUD WITH CARTRIDGE BASED SHUT-OFF FOR SPRAYERS

[75] Inventors: Steven John Gager, Kentwood, Mich.; Robert C. Hudson, Jr., Northbrook, Ill.; Roland Beihl, Invergrove Heights, Minn.

[73] Assignee: H.D. Hudson Manufacturing Company, Chicago, Ill.

[21] Appl. No.: 404,892

[22] Filed: Mar. 15, 1995

[51] Int. Cl.[6] ..... B05B 9/04

[52] U.S. Cl. ..... 239/530; 239/532; 239/583; 239/575

[58] Field of Search ..... 239/152–154, 239/390, 394, 391, 588, 530, 583, 532, 575

[56] References Cited

U.S. PATENT DOCUMENTS

| | | | |
|---|---|---|---|
| 817,054 | 4/1906 | Gay . | |
| 1,751,129 | 3/1930 | Cocks . | |
| 2,852,310 | 9/1958 | Francis | 239/530 X |
| 3,524,593 | 8/1970 | Buckley et al. | 239/530 X |
| 3,637,143 | 1/1972 | Shames et al. | 239/530 X |
| 3,759,445 | 9/1973 | King | 239/588 X |
| 4,034,896 | 7/1977 | Wilson . | |
| 4,043,510 | 8/1977 | Morris . | |
| 4,121,736 | 10/1978 | McGaw, Jr. . | |
| 4,607,795 | 8/1986 | Ettlinger et al. . | |
| 4,618,100 | 10/1986 | White et al. | 239/440 |
| 4,925,105 | 5/1990 | Lin | 239/154 |
| 4,964,540 | 10/1990 | Katz . | |
| 5,303,868 | 4/1994 | Kroll . | |
| 5,398,852 | 3/1995 | Lacy . | |

FOREIGN PATENT DOCUMENTS

| | | | |
|---|---|---|---|
| 1426644 | 9/1988 | U.S.S.R. | 239/530 |
| 1306785 | 2/1973 | United Kingdom | 239/154 |

*Primary Examiner*—Kevin Weldon

*Attorney, Agent, or Firm*—Kane, Dalsimer, Sullivan, Kurucz, Levy, Eisele and Richard, LLP

[57] ABSTRACT

A shroud and cartridge based shut-off for sprayers combine to provide for intermittent and continuous spraying. The shroud affords many different aesthetic possibilities including different colors and colors related to the color of the sprayer tank. The shroud includes an actuator lever for digitally actuating the shut-off valve intermittently. A thumb actuated latch locks the actuator lever in a depressed position for continuous spraying.

16 Claims, 4 Drawing Sheets

SHROUD WITH CARTRIDGE BASED SHUT-OFF FOR SPRAYERS

BACKGROUND OF THE INVENTION

Sprayers of the garden, agricultural or industrial variety which include a tank with hand actuated pump for pressurizing a liquid therein, usually have a valve controlled outlet including a hose, rod and dispensing nozzle. Typical valves for such sprayers are disclosed in commonly assigned U.S. Pat. Nos. 3,321,178, 3,343,795, 3,343,804, 3,670,966 and 4,933,569. With the advent of blow molded sprayer tanks, it is now possible to offer commercial tanks of many different colors. It then becomes desirable to coordinate the color of standard commercially available sprayer valves with the color of the tank for aesthetic and marketing reasons.

Moreover, it has become increasingly important to provide for intermittent as well as continuous spraying without experiencing fatigue should a sprayer be used by a woman or any person being physically weak or a less dexterous individual.

SUMMARY OF THE INVENTION

A principal object of the present invention is to provide a valve for a sprayer with a shroud that permits color coordination with the sprayer tank.

Another object is to provide a shroud of the foregoing type that advantageously receives the valve in the form of a cartridge that permits standardization of the valve, while permitting flexibility in the design and aesthetics of the shroud.

A further object is to provide a shroud of the foregoing type which is digitally manipulated to provide for intermittent or continuous actuation of the valve and, consequently, spraying of the sprayer tank contents.

Another important object is to provide a shroud of the foregoing type which enables an extension rod to be rotated for underleaf as well as overleaf spraying.

Still another object is to provide a shroud of the foregoing type that advantageously receives a filter in cartridge form for filtering out foreign matter that could otherwise cause clogging or sticking of the valve.

Other objects and advantages will become apparent from the following detailed description which is to be taken in conjunction with the accompanying drawings.

Figure 1:
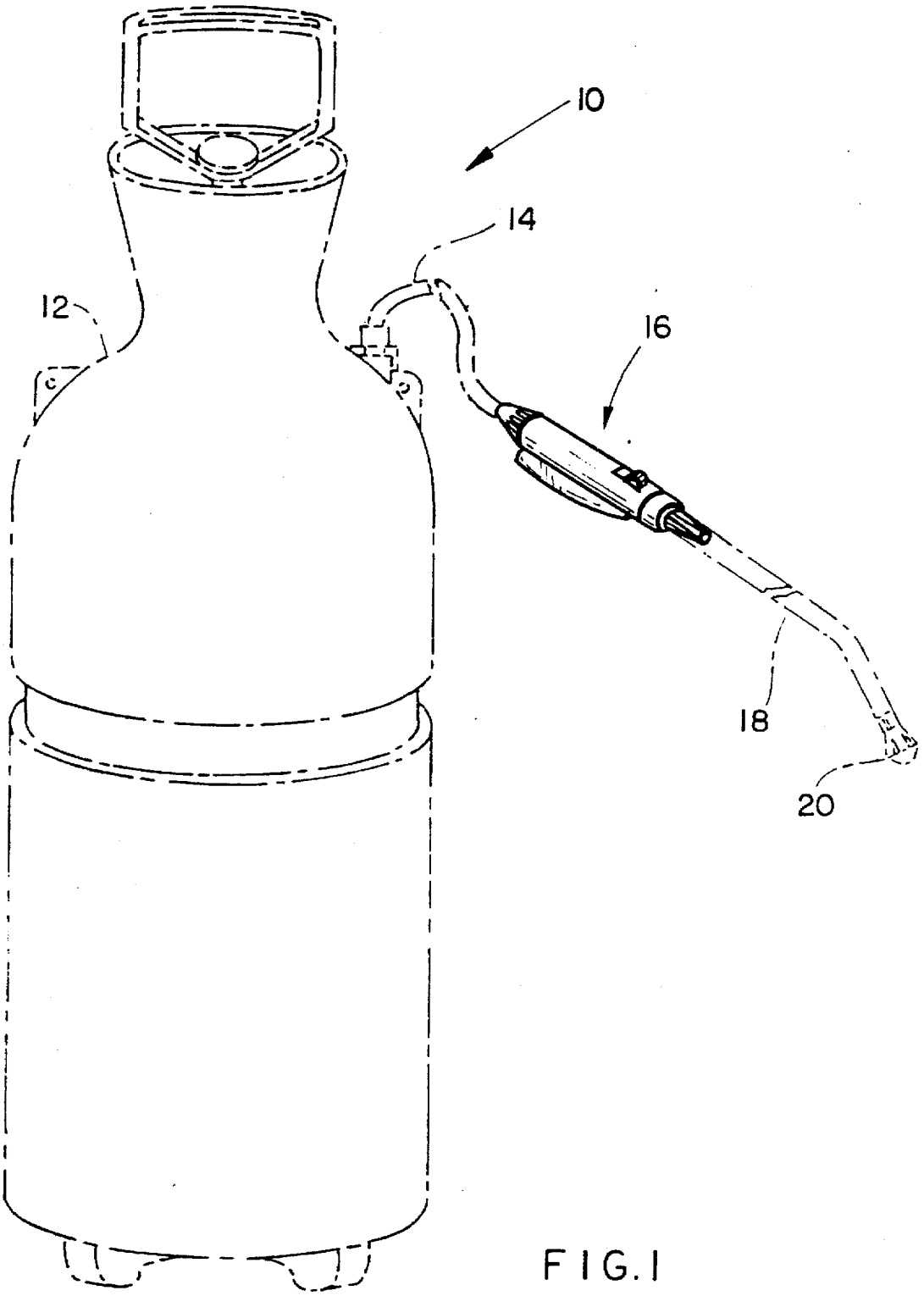
FIG. 1 is a perspective view of the shroud containing a cartridge based shut-off coupled with a sprayer tank and extension rod with discharge nozzle shown in phantom.
Figure 2:
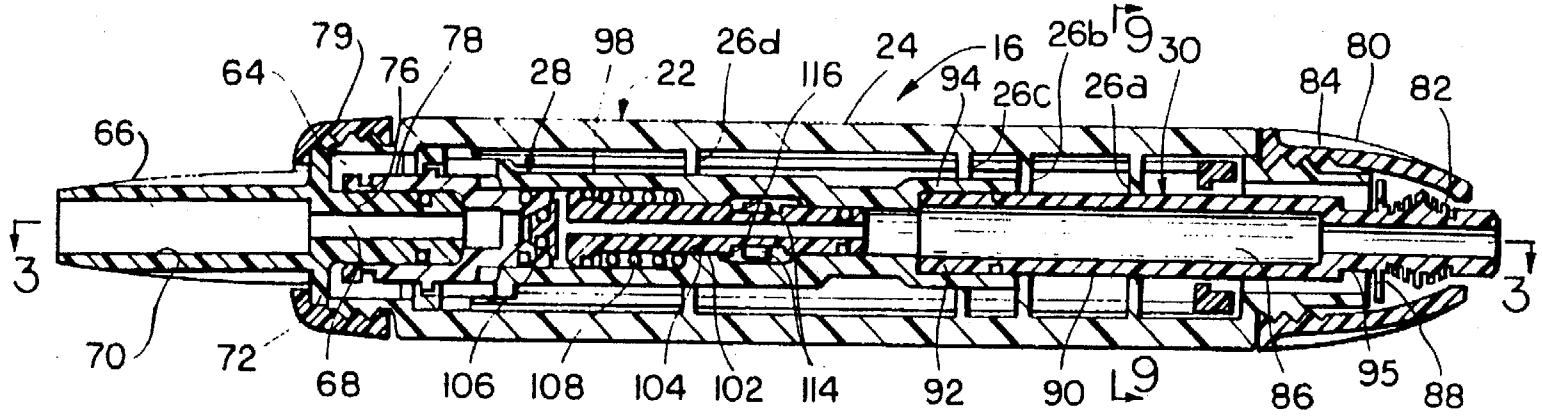
FIG. 2 is a longitudinal sectional view of the shroud containing a valve and filter in cartridge form taken along the line 2—2 of FIG. 3 and showing the valve closed.
Figure 3:
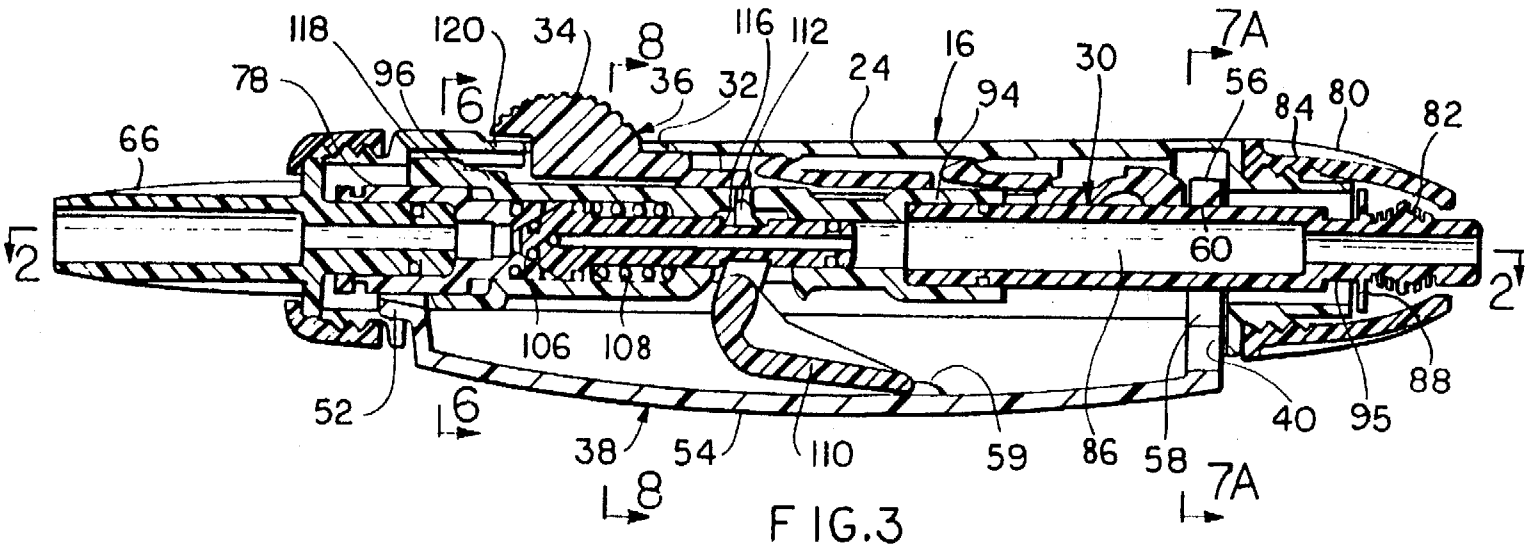
FIG. 3 is a longitudinal sectional view taken along the line 3—3 of FIG. 2.
Figure 4:
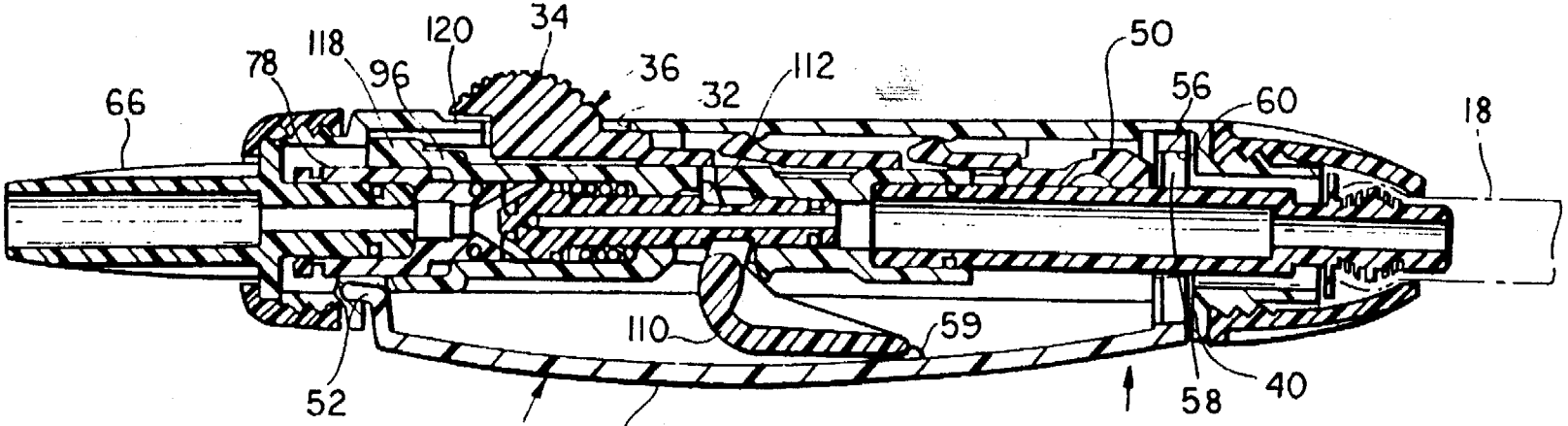
FIG. 4 is a similar longitudinal sectional view showing the shroud actuator lever depressed to open the valve for intermittent spraying.
Figure 5:
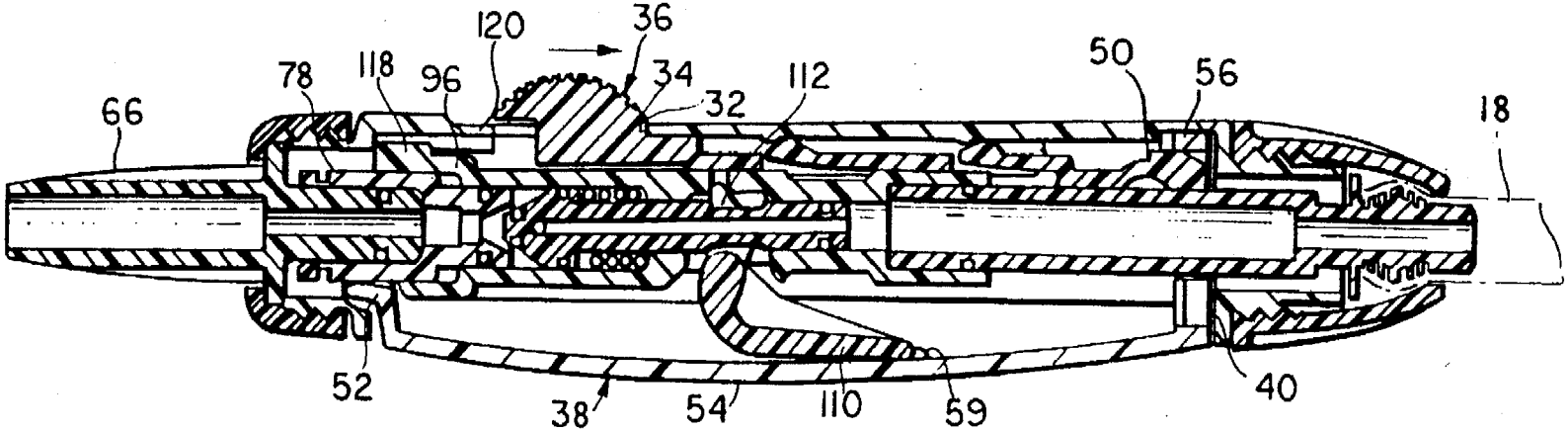
FIG. 5 is a similar longitudinal sectional view showing the depressed shroud actuator lever locked to retain the valve open for continuous spraying.
Figure 7B:
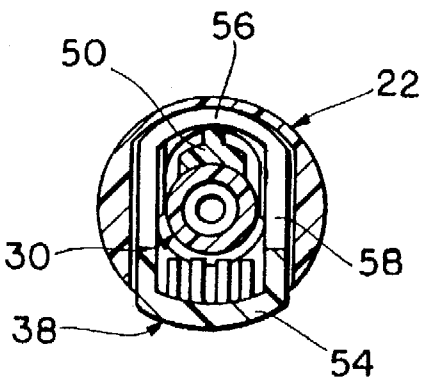
Figure 7A:
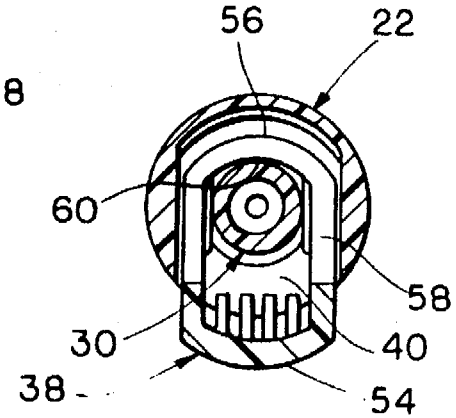
Figure 6:
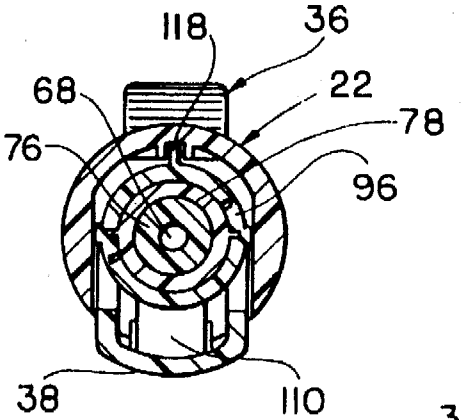
FIG. 6 is a cross sectional view taken along the line 6—6 of FIG. 3.
Figure 9:
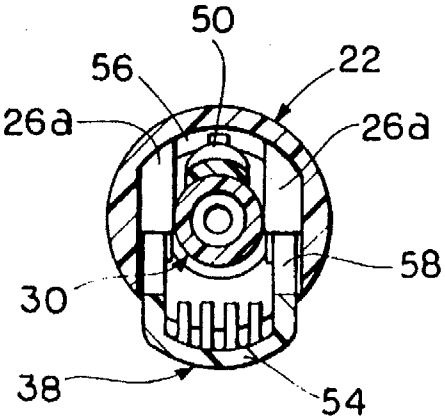
Figure 8:
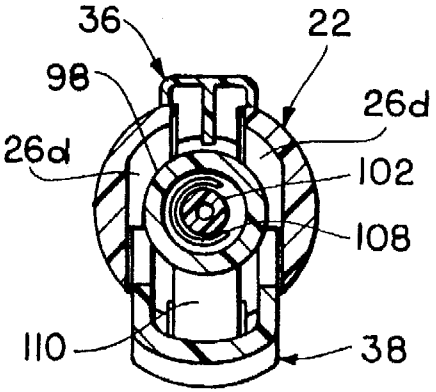

FIG. *7a* is a cross sectional view taken along the line *7a—7a* of FIG. 3;

FIG. *7b* is a cross sectional view taken along the line *7b—7b* of FIG. 5;

FIG. 8 is a cross sectional view taken along the line 8—8 of FIG. 3; and FIG. 9 is a cross sectional view taken along the line 9—9 of FIG. 3.

Figure 10:
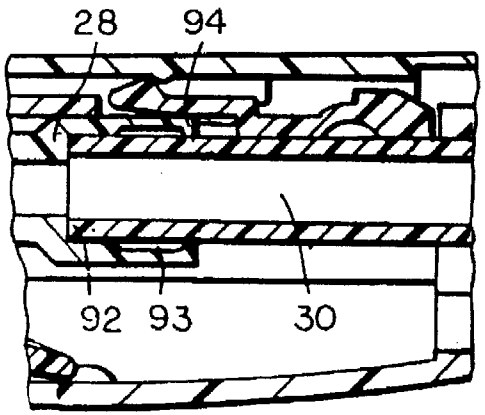

FIG. 10 is an enlarged fragmentary sectional view illustrating a safety feature of the present invention to detect pressurization of the tank when an attempt is made to uncouple the hose connection.

DETAILED DESCRIPTION

In the drawings, a compression sprayer 10 includes a blow molded plastic tank 12 from which extends a hose 14 which is connected with a shroud and cartridge based shut-off assembly 16 of the invention which in turn, is connected with an extension rod 18 having a discharge nozzle 20.

Referring to the assembly 16 of this invention, the shroud 22 includes a housing 24 having a series of spaced lateral ribs 26 for increasing housing rigidity and for conveniently receiving and centering the cartridge based shut-off 28 and filter cartridge 30. The housing 24 is provided with a lateral opening 32 for exposing a digitally engaging protrusion 34 of a thumb latch or lock 36 which is slidable longitudinally to release and lock in a depressed position an actuator lever 38 extending outwardly through a larger lateral opening 40 of the housing 24.

The thumb latch 36 is formed with a pair of cantilevered spring arms 42 having laterally extending triangular lugs 44 which advantageously ride between a pair of elongated centering ribs 46. The combination of spring arms 42 with triangular lugs 44 and centering ribs 46 prevent the thumb latch from sticking and not move smoothly by effectively decreasing friction. The distal end of the thumb latch 36 includes the lateral protrusion 34 which includes a pair of opposed edges 48 for riding on the exterior of the housing 24. The proximal end of the thumb latch 36 is provided with a lateral latching lug 50 for engaging surfaces of the actuator lever 38 to lock it in a depressed position for continuous spraying. In this regard, the thumb latch is movable between a forward position at which it does not engage the actuator lever 38 to permit intermittent spraying to a rearward position at which it engages the actuator lever 38 in its depressed position for continuous spraying The actuator lever 38 includes at its distal end, a projection 52 which is pivotal on an interior surface of the housing 24 and is disposed between this surface and the exterior surface of the cartridge based shut-off 28. The finger engaging intermediate part 54 extends outwardly of the opening 40 of housing 24. The proximal end of the actuator lever 38 includes a lateral latching arm 56 having opening 58 that permits the filter cartridge 30 to extend therethrough. In addition this opening 58 is adapted to receive the latching lug 50 of the thumb latch 30 so that it will engage the inner edge 60 of the latching arm 56 to latch the actuator lever 38 in its depressed position for continuous spraying. A pair of bearing points 59 on the interior of the intermediate part 54 for engaging directly with the actuator arm of the cartridge based shut-off 28 with decreased friction.

At the distal end 64 of the housing 24 is a rotatable nose cone 66 having a bore 68 and a forward larger bore 70 which conveniently receives extension rod 18 in a fluid tight manner well known in the art. The nose cone 66 includes a circumferentially extending radial flange 72 which engage with internally threaded front retainer nut 74 threadedly received on the externally threaded housing distal end 64.

The rear end 76 of the nose cone 66 is relatively rotatable in and sealingly engaged with valve seat member 78.

The distal end 80 of housing 24 tightly engages with external surfaces of the hose 14 which is tightly expanded over the grooved conical faces on the proximal end 82 of the filter cartridge 30. In order to further secure this liquid tight connection, an internally threaded rear retainer nut 84 may be received on the externally threaded distal end 80 of housing 24.

The filter cartridge 30 includes a suitable filter material capable of filtering foreign matter so as to prevent clogging and sticking of the valve of the cartridge based shut-off 28. A radial flange 88 engages in the housing proximal end 80 and this provides a positive stop for assembly of the hose on the hose connector. In addition the exterior of the housing 90 of the filter cartridge is tightly cradled in the ribs **26*a* and 26*b*, as shown, and consequently centered or coaxial within the housing 24 and with respect to the cartridge based shut-off 28. The inner end 92 of the filter cartridge 30 is sealingly engaged within the proximal end 94 of the cartridge based shut-off 28. In accordance with an embodiment of this invention, a groove 93 in the proximal end 94 of housing 28 provides sight/sound warning that tank has not been depressurized before the user removes rear retainer nut 84, all the way. If the tank is pressurized, as the person removes the rear retainer nut 84 the pressure pushes back the filter cartridge 30 unit until the inner end 92 of the filter cartridge is past the groove 93. At this point fluid or air can escape causing an audible and visual (liquid on hands) warning that there is still pressure in the tank before rear retainer nut 84 is unthreaded completely. Groove 95 is adjacent the flange 88**.

Referring now to the cartridge based shut-off 28, the distal end 96 of valve cylinder 98 sealingly couples with the valve seat member 78 which is provided with conical valve seat 100. Valve 102 is reciprocal in the bore 104 of the valve cylinder 98 and includes a conical front end 106 adapted to engage with the conical valve seat 100 to close the bore 104 and liquid passage through the cartridge based shut-off assembly 16. This closed position is maintained by the bias of spring 108. In order to open the valve 102 by retracting its conical front end 106 from the conical valve seat 100 against the bias of spring 108, a valve actuator 110 is provided. This actuator 110 is pivotal at end 112 disposed in accommodating recess 113 of valve cylinder 98 and is provided with a pair of arms 114 which are disposed in external recesses 116 and engage external surfaces of the recesses. An actuator arm 120 extends outwardly from the valve cylinder 98 for engagement by the actuator lever 38. In this connection depression of the actuator arm 120 will cause it to pivot about end 112 causing the arms 114 to engage surfaces of the recesses 116 and force valve 102 rearwardly to unseat its end 106 from valve seat 100 to permit liquid flow. Release of the actuator arm 110 will have spring 108 move valve 102 forwardly 5 seating end 106 on seat 100 to stop liquid flow. External longitudinal lug 118 on the valve cylinder 98 fits in slot 120 on the interior of housing 24 to serve to properly orient the cartridge based shut-off 28 in the housing 24.

In operation, when it is desired to spray intermittently, the actuator lever 38 is depressed causing the actuator arm 110 to rotate to retract and unseat valve 102. Release of the actuator 38 will cause spring 108 to return valve 102 to its closed position. When it is desired to spray continuously, the actuator lever 38 is depressed to unseat the valve 102 and while in the depressed position the thumb latch 36 is moved rearwardly to have latching lug 50 engage the inner edge 60 of the lateral latching arm 56 of actuator lever 38. Shifting the thumb latch forward and release of the actuator lever 38 will then permit the spring 108 to return the valve 102 to its closed position.

Although a single somewhat preferred embodiment has been disclosed and described in detail herein, it should be understood that this invention is in no sense limited thereby and its scope is to be determined by that of the appended claims.

What is claimed is:

1. The combination of a shroud and cartridge based shut-off having an axis for sprayers, comprising:

a shroud comprising a tubular housing receiving therein and centering the shut-off and being substantially aligned with the axis and having an exterior and interior first coupling means for coupling with an extension rod and nozzle, a second coupling means for coupling with a hose and spray tank, an actuator lever extending substantially in the same direction as the axis and pivotally mounted on the housing from an outer position away from the axis at which the cartridge based shut-off is closed to an inner position laterally towards the axis at which the cartridge based shut-off is engaged and shifted to an open position for intermittent spraying, and thumb actuated latch means movable in the direction of the axis for releasably latching the actuator in the inner position to maintain the cartridge based shut-off in the open position for continuous spraying, mounting means for mounting and centering the cartridge based shut-off interiorly of the housing and along the axis;

the cartridge based shut-off comprising a cylinder having a bore coaxial with the axis, a valve seat within the cylinder, an axially reciprocal valve reciprocal from a valve closed position in engagement with the valve seat to seal off the bore and a valve open position out of engagement with the valve seat to open the bore, a spring for biasing the valve into engagement with the valve seat, and a laterally extending shiftable actuator having engagement means for engaging the valve and being shiftable from a first position at which the valve is in engagement with the valve seat and a second position at which the actuator reciprocates the valve to the valve open position to open the bore against the bias of the spring, and the actuator lever being adapted to engage the actuator upon being pivotal to the inner position to shift the actuator to the second position at which the valve is reciprocated to the valve open position to open the bore.

2. The invention in accordance with claim 1 wherein a filter housing is axially aligned with the cylinder and has a bore in fluid communication with the bore of the cylinder, and a filter within the bore of the filter housing.

3. The invention in accordance with claim 1 wherein the first coupling includes a rotatable nose cone and a retainer nut for rotatably connecting the nose cone to the shroud housing, the nose cone adapted to be coupled with an extension rod and nozzle whereupon the extension rod may be rotated for underleaf as well as overleaf spraying.

4. The invention in accordance with claim 1 wherein surfaces of the housing and valve cylinder having mating lugs and recesses for orienting the cartridge based shut-off so that the actuator of the cartridge based shut-off and actuator lever of the shroud are aligned for engagement with one another.

5. The invention in accordance with claim 1 wherein the second coupling means includes a hose connector having a bore in fluid communication with the hose of the cylinder, the hose connector having a conical exterior surface and a series of rings on the conical exterior surface, and a rear retainer nut threadedly engaged with the shroud housing for pressing the hose on the rings to provide a leak proof seal therebetween.

6. The invention in accordance with claim 1 wherein means are provided for preventing binding of the valve upon the shut off experiencing increased back pressure.

7. The invention in accordance with claim 1 wherein the shroud housing and thumb actuated latch means providing interengaging surfaces of reduced friction to prevent binding of the thumb actuated latch means.

8. The invention in accordance with claim 1 wherein ribs are provided on the interior of the shroud housing to increase the rigidity of the shroud housing.

9. The combination of a shroud and cartridge based shut-off for sprayers, comprising:

a shroud comprising a housing having an exterior and interior first coupling means for coupling with an extension rod and nozzle, a second coupling means for coupling with a hose and spray tank, an actuator lever pivotally mounted on the housing from an outer position at which the cartridge based shut-off is closed to an inner position at which the cartridge based shut-off is engaged and shifted to an open position for intermittent spraying, and thumb actuated latch means for releasably latching the actuator in the inner position to maintain the cartridge based shut-off in the open position for continuous spraying, mounting means for mounting the cartridge based shut-off interiorly of the housing;

the cartridge based shut-off comprising a cylinder having a bore and an axis, a valve seat within the cylinder, an axially reciprocal valve reciprocal from a valve closed position in engagement with the valve seat to seal off the bore and a valve open position out of engagement with the valve seat to open the bore, a spring for biasing the valve into engagement with the valve seat, and a laterally extending shiftable actuator having engagement means for engaging the valve and being shiftable from a first position at which the valve is in engagement with the valve seat and a second position at which the actuator reciprocates the valve to the valve open position to open the bore against the bias of the spring, and the actuator lever being adapted to engage the actuator upon being pivotal to the inner position to shift the actuator to the second position at which the valve is reciprocated to the valve open position to open the bore;

the shroud actuator lever including bearing parts for reducing friction upon engagement with the cartridge based shut-off actuator.

10. The combination of a shroud and cartridge based shut-off for sprayers, comprising:

a shroud comprising a housing having an exterior and interior first coupling means for coupling with an extension rod and nozzle, a second coupling means for coupling with a hose and spray tank, an actuator lever pivotally mounted on the housing from an outer position at which the cartridge based shut-off is closed to an inner position at which the cartridge based shut-off is engaged and shifted to an open position for intermittent spraying, and thumb actuated latch means for releasably latching the actuator in the inner position to maintain the cartridge based shut-off in the open position for continuous spraying, mounting means for mounting the cartridge based shut-off interiorly of the housing;

the cartridge based shut-off comprising a cylinder having a bore and an axis, a valve seat within the cylinder, an axially reciprocal valve reciprocal from a valve closed position in engagement with the valve seat to seal off the bore and a valve open position out of engagement with the valve seat to open the bore, a spring for biasing the valve into engagement with the valve seat, and a laterally extending shiftable actuator having engagement means for engaging the valve and being shiftable from a first position at which the valve is in engagement with the valve seat and a second position at which the actuator reciprocates the valve to the valve open position to open the bore against the bias of the spring, and the actuator lever being adapted to engage the actuator upon being pivotal to the inner position to shift the actuator to the second position at which the valve is reciprocated to the valve open position to open the bore;

a filter housing being axially aligned with the cylinder and has a bore in fluid communication with the bore of the cylinder, and a filter within the bore of the filter housing, the first coupling including a rotatable nose cone and a retainer nut for rotatably connecting the nose cone to the shroud housing, the nose cone adapted to be coupled with an extension rod and nozzle whereupon the extension rod may be rotated for underleaf as well as overleaf spraying, surfaces of the housing and valve cylinder having mating lugs and recesses for orienting the cartridge based shut-off so that the actuator of the cartridge based shut-off and actuator lever of the shroud are aligned for engagement with one another, the second coupling means includes a hose connector having a bore in fluid communication with the hose of the cylinder, the hose connector having a conical exterior surface and a series of rings on the conical exterior surface, and a rear retainer nut threadedly engaged with the shroud housing for pressing the hose on the rings to provide a leak proof seal therebetween, means are provided for preventing binding of the valve upon the shut off experiencing increased back pressure, the shroud housing and thumb actuated latch means providing interengaging surfaces of reduced friction to prevent binding of the thumb actuated latch means, ribs are provided on the interior of the shroud housing to increase the rigidity of the shroud housing, the shroud actuator lever includes bearing parts for reducing friction upon engagement with the cartridge based shut-off actuator.

11. A shroud for a cartridge based shut-off for sprayers, comprising:

a housing having an exterior and interior first coupling means for coupling with an extension rod and nozzle, a second coupling means for coupling with a hose and spray tank, an actuator lever pivotally mounted on the housing from an outer position at which the cartridge based shut-off is closed to an inner position at which the cartridge based shut-off is engaged and shifted to an open position for intermittent spraying, the shroud actuator lever including bearing means for reducing friction upon engagement with surfaces of the cartridge based shut-off, and thumb actuated latch means for releasably latching the actuator in the inner position to maintain the cartridge based shut-off in the open position for continuous spraying, mounting means for mounting the cartridge based shut-off interiorly of the housing.

12. The invention in accordance with claim 11 wherein the first coupling includes a rotatable nose cone and a retainer nut for rotatably connecting the nose cone to the shroud housing, the nose cone adapted to be coupled with an extension rod and nozzle whereupon the extension rod may be rotated for underleaf as well as overleaf spraying.

13. The invention in accordance with claim 11 wherein the second coupling means includes a hose connector having a bore in fluid communication with the hose of the cylinder, the hose connector having a conical exterior surface and a series of rings on the conical exterior surface, and a rear retainer nut threadedly engaged with the shroud housing for pressing the hose on the rings to provide a leak proof seal therebetween.

14. The invention in accordance with claim 11 wherein the shroud housing and thumb actuated latch means providing interengaging surfaces of reduced friction to prevent binding of the thumb actuated latch means.

15. The invention in accordance with claim 11 wherein ribs are provided on the interior of the shroud housing to increase the rigidity of the shroud housing.

16. A shroud for a cartridge based shut-off for sprayers, comprising:

a housing having an exterior and interior first coupling means for coupling with an extension rod and nozzle, a second coupling means for coupling with a hose and spray tank, an actuator lever pivotally mounted on the housing from an outer position at which the cartridge based shut-off is closed to an inner position at which the cartridge based shut-off is engaged and shifted to an open position for intermittent spraying, and thumb actuated latch means for releasably latching the actuator in the inner position to maintain the cartridge based shut-off in the open position for continuous spraying, mounting means for mounting the cartridge based shut-off interiorly of the housing, the first coupling including a rotatable nose cone and a retainer nut for rotatably connecting the nose cone to the shroud housing, the nose cone adapted to be coupled with an extension rod and nozzle whereupon the extension rod may be rotated for underleaf as well as overleaf spraying, the second coupling means including a hose connector having a bore in fluid communication with the hose of the cylinder, the hose connector having a conical exterior surface and a series of rings on the conical exterior surface, and a rear retainer nut threadedly engaged with the shroud housing for pressing the hose on the rings to provide a leak proof seal therebetween, the shroud housing and thumb actuated latch means providing interengaging surfaces of reduced friction to prevent binding of the thumb actuated latch means, ribs are provided on the interior of the shroud housing to increase the rigidity of the shroud housing.

* * * * *